United States Patent [19]

Wilson

[11] Patent Number: 4,725,108

[45] Date of Patent: Feb. 16, 1988

[54] HORIZONTAL DROPOUT FILE STORAGE DRAWER

[76] Inventor: Robert W. Wilson, 221 Mainsail Ct., Foster City, Calif. 94404

[21] Appl. No.: 918,904

[22] Filed: Oct. 15, 1986

[51] Int. Cl.[4] ..... A47B 88/06

[52] U.S. Cl. ..... 312/323; 312/348

[58] Field of Search ..... 312/322, 323, 333, 348

[56] References Cited

U.S. PATENT DOCUMENTS

| | | | |
|---|---|---|---|
| 577,881 | 3/1897 | Puffer | 312/323 |
| 1,137,074 | 4/1915 | Morris | 312/323 |
| 1,774,236 | 8/1930 | Ohnstrand | 312/348 UX |
| 3,320,010 | 5/1967 | Ritzerfeld | 312/323 |
| 4,441,771 | 4/1984 | Roesler | 312/323 X |

*Primary Examiner*—Joseph Falk

*Attorney, Agent, or Firm*—Gilden & Israel

[57] ABSTRACT

A dropout file storage drawer is slidably mounted on a bearing track assembly and includes a forwardly positioned cam and follower arrangement which permits the drawer to slope slightly downwardly while it is being pulled out of its associated cabinet. The slope angle continually increases as the drawer is pulled farther out of the cabinet, while a rearwardly positioned stop limits the distance of drawer removal. If desired, the drawer can be moved over the stop so as to permit the drawer to be turned downwardly to a substantially vertical angle while still being attached to the bearing track assembly.

7 Claims, 8 Drawing Figures

HORIZONTAL DROPOUT FILE STORAGE DRAWER

BACKGROUND OF THE INVENTION

1. Field of the Invention

The present invention relates to file storage drawers slidably movable within cabinets, and more particularly pertains to a pivotable drawer attached on a movable roller assembly whereby the drawer may be dropped down at an angle while still being attached to the file or storage cabinet, thereby to facilitate easy access to and viewing of the contents of the drawer.

2. Description of the Prior Art

The use of containers or drawers which are slidably mounted in an associated cabinet is well known in the prior art. Further, the concept of having containers or drawers which can move forward and can stay suspended in a tilted work position is also known in the prior art; however, the number of such drawer assemblies which are commercially available is extremely limited. Most likely, this unavailability of supply is occasioned by the complexities of the design and manufacturing requirements of such assemblies. Accordingly, it can be appreciated that there exists a continuing need for feasibly designed file storage drawers which can stay suspended in their associated cabinets while being maintained in a tilted work position, and in this respect, the present invention substantially fulfills this need.

SUMMARY OF THE INVENTION

In view of the foregoing disadvantages inherent in the known types of tiltable file storage drawers now present in the prior art, the present invention provides an improved tiltable suspended file storage drawer assembly wherein the same can be securely pivotally attached to an associated cabinet while being provided with a variable tilt angle to meet the needs of the user. As such, the general purpose of the present invention which will be described subsequently in greater detail, is to provide a new and improved tiltable file storage drawer assembly which has all the advantages of the prior art tiltable drawer assemblies and none of the disadvantages.

To attain this, the present invention envisions a drawer slidably mounted on a bearing track assembly, with the drawer being pivotally attached thereto by a hinge assembly. The hinge is attached to a rear base portion of the drawer, while being further attached to the telescoping bearing track assembly, while a forward base portion of the drawer is provided with a cam surface slidably movable over a roller type follower. The cam permits an immediate downward tilting of the drawer during its initial extraction from the cabinet, and the hinge then permits the angle of tilt to increase as the drawer is further extended. A stop means provided on the hinge abuts against an adjustable of fixed block to thus limit the extent of drawer extension from the cabinet, while also limiting the tilt angle. The block is of a predetermined height so that the stop means on the hinge can be moved above and past the block, thereby to permit an even further extension of the drawer from the cabinet and also a much greater tilt angle.

A further noteworthy feature of invention includes a liner which can be retained within the drawer, with the liner being easily removable when the drawer is in a fully extended position The removable liner facilitates the storage of documents and other items within the drawer and their easy removal therefrom.

There has been thus outlined, rather broadly, the more important features of the present invention in order that the detailed description thereof that follows may be better understood, and in order that the present contribution to the art may be better appreciated. There are, of course, additional features of the invention that will be described hereinafter which will form the subject matter of the claims appended hereto. Those skilled in the art will apprciate that the conception, upon which this disclosure is based, may readily be utilized as a basis for the designing of other structures, methods and systems for carrying out the several purposes of the present invention. It is important, therefore, that the claims be regarded as including such equivalent constructions so far as they do not depart from the spirit and scope of the present invention.

It should be further noted that the purpose of the foregoing abstract is to enable the Patent Office and the public generally, and especially the scientists, engineers or practitioners in the art who are not familiar with patent or legal terms or phraseology, to determine quicky from a cursory inspection the nature and essence of the technical disclosure of this application. The abstract is neither intended to define the invention, which is measured by the claims, nor is it intended to be limiting as to the scope of the invention in any way.

It is therefore an object of the present invention to provide a new and improved tiltable drawer assembly which has all the advantages of the prior art tiltable drawer assemblies and none of the disadvantages.

It is another object of the present invention to provide a new and improved tiltable drawer assembly which may be easily and efficiently manufactured and marketed.

It is a further object of the present invention to provide a new and improved tiltable drawer assembly which is of a durable and reliable construction, and which is adaptable for use in conventional drawer storage cabinets.

It is still another object of the present invention to provide a new and improved tiltable drawer assembly which provides for variable tilt angles during a suspension thereof from an associated cabinet.

Yet another object of the present invention is to provide a new and improved tiltable drawer assembly which is characterized by a lightweight and stable construction, thereby to facilitate its installation and use in existing storage cabinets.

An even further object of the present invention is to provide a new and improved tiltable drawer assembly which is susceptible of a low cost of manufacture with regard to both materials and labor, and which accordingly is then susceptible of low prices of sale to the consuming public, thereby making such tiltable drawer assemblies economically available to the buying public.

Still yet another object of the present invention is to provide a new and improved tiltable drawer assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
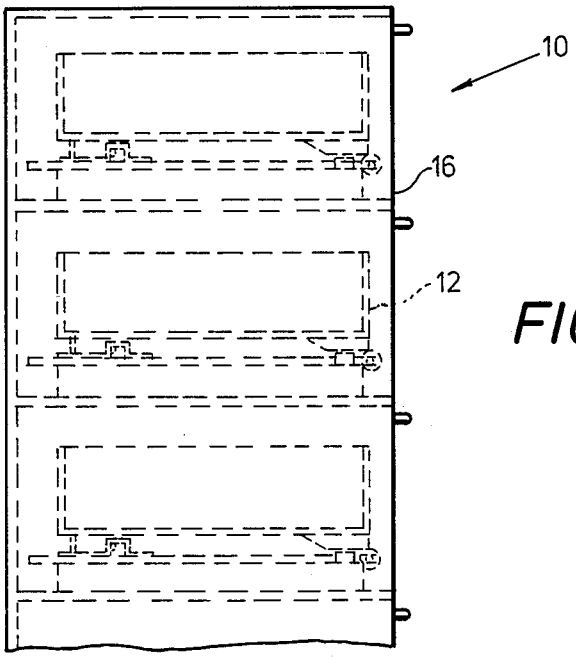
FIG. 1 is a side elevation view showing the tiltable drawer assemblies of the present invention operably installed in an associated cabinet.
Figure 2:
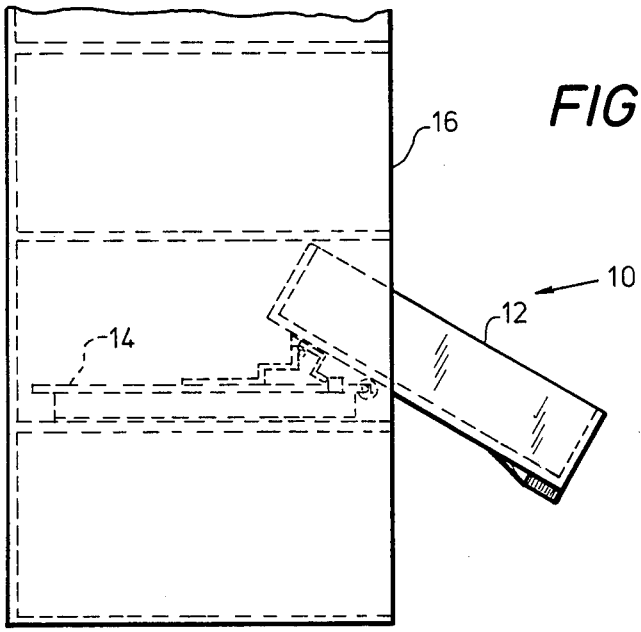
FIG. 2 is a side elevation view of a cabinet wherein a tiltable drawer is suspended outwardly therefrom.

With reference now to the drawings, and in particular to FIGS. 1 and 2 thereof, a new and improved tiltable drawer assembly embodying the principles and concepts of the present invention and generally designated by the reference numeral 10 will be described.

More specifically, it will be noted that the tiltable drawer assembly 10 includes a conventionally shaped drawer 12 slidably mounted on a bearing track assembly 14 which in turn is fixedly securable within a conventional file drawer storage cabinet 16. As shown in FIG. 1, the drawers 12 are normally positioned in a conventional manner within the storage cabinet 16 while, as shown in FIG. 2, the drawers tilt downwardly when pulled outwardly from the cabinet.

Figure 3:
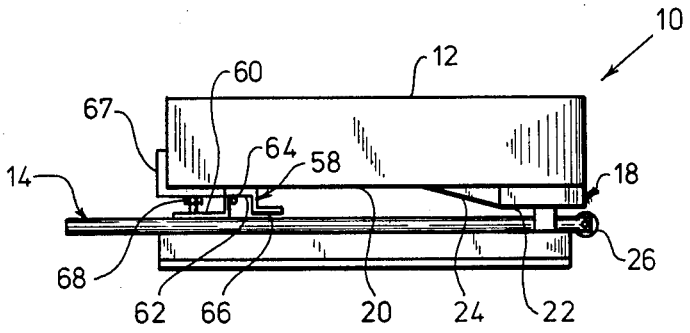
FIG. 3 is a side elevation view of the tiltable drawer assembly comprising the present invention, wherein the same is operably removed from its associated cabinet.
Figure 4:
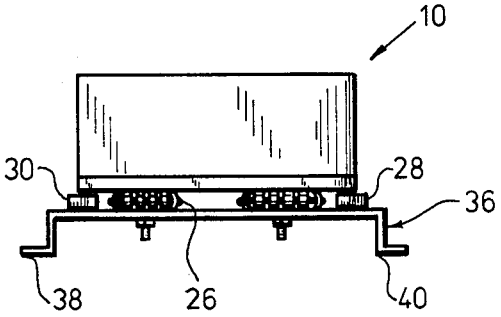
FIG. 4 is a front elevation view of the invention.

With reference to FIGS. 3 and 4 of the drawings, it will be observed that the tiltable drawer assembly 10 is shwon removed from its associated storage cabinet 16. As illustrated, the drawer 12 includes a fowardly positioned cam member 18 which is fixedly secured to a forward bottom or base portion 20 of the drawer. The cam member 18 includes a first flat portion 22 which provides for an initial forward level movement of the drawer 12, and then includes a upwardly sloped cam surface 24 integrally attached thereto. The cam member 18 essentially rests upon and is slidably movable over a plurality of rollers 26 which are permanently, fixedly secured to the aforementioned bearing track assembly 14 or separately attached to the rigid base member (36). Depending upon the specific design of the tiltable drawer assembly 10, the cam member may also rest upon and slidably move over a pair of stop members 28, 30 fixedly or adjustably secured proximate to and positioned on opposite sides of the bearing track assembly 14. However, in the preferred embodiment of the invention, the cam member 18 would be in contact only with the rollers 26, while the stop members 28, 30 would be slightly spaced apart therefrom.

Figure 7:
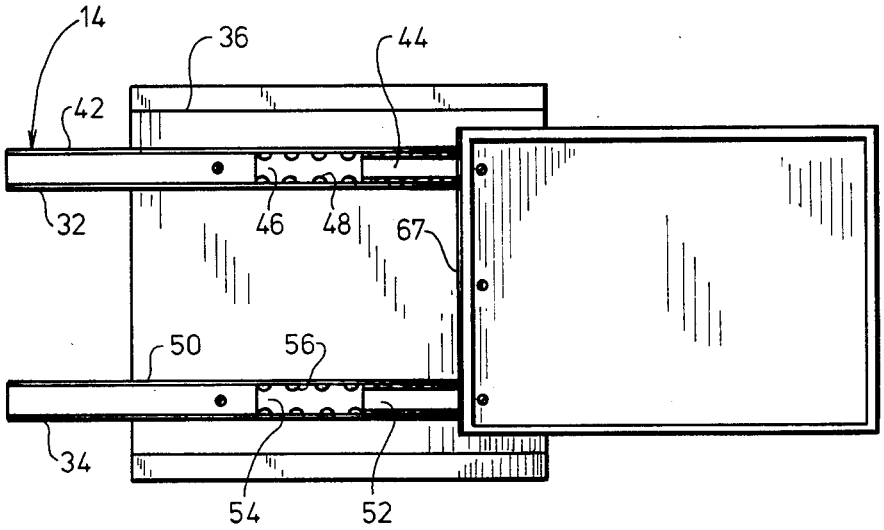
FIG. 7 is a top plan view of the extended drawer comprising the invention.

Referencing FIG. 7 concurrently with FIGS. 3 and 4, it will be noted that the bearing track assembly 14 essentially comprises a pair of bearing tracks 32, 34 fixedly and parallelly mounted to a rigid base member 36. The base member 36 essentially consists of a rigid metal plate having downwardly extending flanged lips 38, 40 which are fixedly securable to an interior portion of the storage cabinet 16 by some conventional means, such as through the use of threaded fasteners or the like. The bearing tracks 32, 34 are identical in design. In this respect, the bearing track 32 includes an upwardly facing U-shaped channel member 44, and a conventional sliding plate member 46 positioned therebetween. The plate member 46 includes a plurality of captured ball bearings 48, with such bearings constituting the movable contact between the channel members 42, 44.

Similarly, the bearing track 34 includes an upwardly facing U-shaped channel member 50, a downwardly facing U-shaped channel member 52, and a slidable intermediate member 54 also having a plurality of captured ball bearings 56. As can be appreciated, the channel members 42, 50 are fixedly secured to a top surface of the base member 36, while the downwardly facing channel members 44, 52 have the drawer 12 fixedly secured to topmost portions thereof.

As best illustrated in FIG. 3, the drawer 12 includes a rearedly positioned hinge assembly 58 that is fixedly secured to an L-shaped bracket 67 that is fixedly secured to a bottom 20 and rear surface sides of the drawer and which is further fixedly secured to the channel members 44, 52. The bracket 67 prohibits binding action of the slides 32, 34, and allows for removal of drawer 12 without complete disassembly of the entire unit 10 from the cabinet. In this regard, the hinge assembly 58 would normally consist of a pair of such hinges positioned on respective sides of the drawer bottom 20, with each such hinge including a first leg 60 attached to respective ones of the channel members 44, 52, and a second leg 62 fixedly secured to the drawer bottom 20. The conventional pivotable hinge pin 64 is then positioned between the hinge legs 60, 62 in a well known manner.

As a further novel features of the present invention, the hinge leg 64 on each of the hinge assemblies 58 is provided with a downwardly extending L-shaped integral leg member 66, with such leg member being spaced above the respective channel members 44, 52 and being operable to engage the aforementioned respective blocks or stops 28, 30 in a manner to be subsequently described. The downwardly extending stop engaging members 66 are integrally formed as a part of the hinge assembly 58, although it is within the intent and purview of the present invention to utilize separable members which would also function in the desired manner.

Lastly illustrated in the FIG. 3 is a downwardly extending support member 68 which in the preferred embodiment of the invention consists of one or more machine screws, whereby such screws operate to maintain a drawer 12 in a level position when the same is within a storage cabinet 16. The length of the support members 68 is of course adjustable to achieve the desired leveling and in the preferred embodiment, only two such support members are used—each of which extends through a rearward portion of the drawer bottom 20 and each of which abutts directly against the hinge leg members 60.

OPERATION

Figure 5:
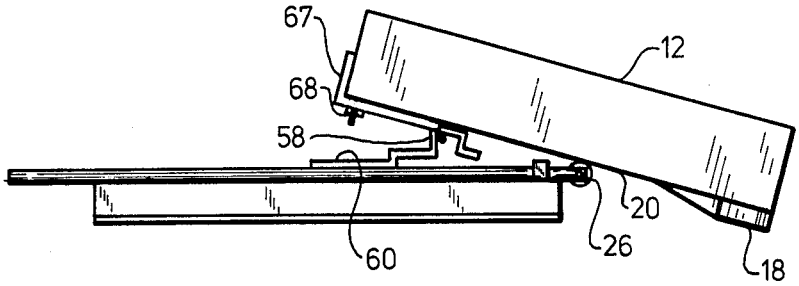
FIG. 5 is a side elevation view of the invention showing the drawer partially extended.

With respect to the manner of operation of the present invention, it can be appreciated that the tiltable drawer assembly 10 is normally fixedly secured within a storage cabinet 16, as best illustrated in FIGS. 1 and 2. During an extension of a drawer 12 from a storage cabinet 16, a tilting downwardly thereof will be experienced and in this respect, reference is made to FIGS. 5, 6 and 7 for a complete description of this operation. More specifically, during an initial withdrawal of drawer 12, the cam member 18 slides over the rollers 26 and eventually moves past the rollers, whereby the rollers now engage the drawer bottom 20 to achieve an initial downward tilt thereof. Of course, the hinge assembly 58 permits this downward tilting of drawer 12, while the support members 68 move upward from their contact with the hinge legs 60.

Figure 6:
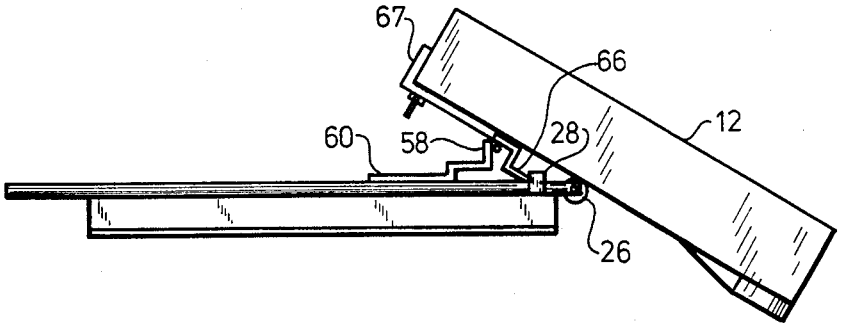
FIG. 6 is a side elevation view of the invention showing the drawer in a first fully extended position.
Figure 8:
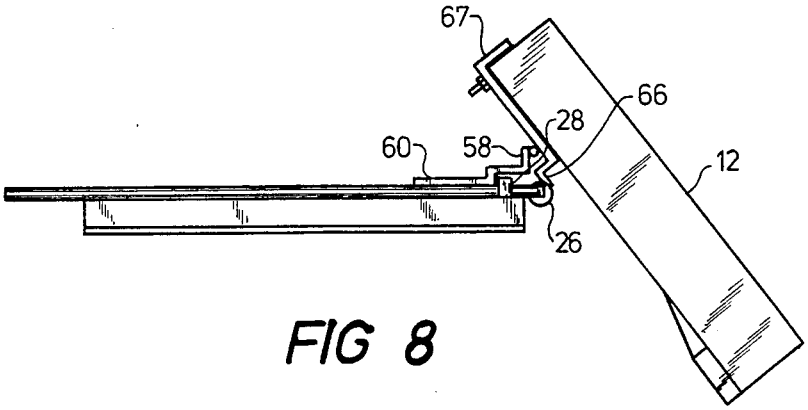
FIG. 8 discloses a drawer in a second tilt position.

The result of a continued drawer extension are best illustrated in FIG. 6, wherein it will be noted that the tilt angle increases continually until the drawer 12 reaches the first limit of its extension as occasioned by the pair of leg members 66 coming into abutting relationship with the associated respective stop members 28, 30. In the event that this initial extension and tilting of the suspended drawer 12 is not sufficient for the purposes of the user, a lifting up of the drawer will result in the leg members 66 moving above the respective stop members 28, 30, thereby to permit a futher extending of the drawer outwardly from the associated cabinet 16. As is now apparent, the drawer 12 may be further extended until the leg members 60 abutt against the rollers 26, while the hinge assembly 58 facilitates an even greater downward tilting of the drawer. In this regard, the drawer 12 may be substantially tilted into a vertical position if desired to meet the needs of the user. In the event that a drawer liner is used, the liner may be lifted out of the drawer 12 to facilitate access to the contents thereof.

In summary, it should be realized that the intent and purview of the present invention is to utilize the concept thereof in virtually any conceivable construction involving storage or file cabinets. For example, the concept could be applied to a complete cabinet assembly, i.e., a file cabinet could be produced wherein the aforementioned mechanism could be incorporated with flipper doors or, alternatively, receding doors while virtually any desired upward or downward angle of the drawer could then be produced. Further, there should be an interlocking mechanism to prevent more than one drawer from being opened at a time. Of course, counterbalancing weights or legs could be utilized to overcome the forces generated when a drawer 12 and its associated tilt mechanism is extended from cabinet 16. In effect, the purpose and concept of the present invention is to produce a product which can be applied to drawers, shelves, filing systems, bin storage assemblies, assembly-line workstations or workbenches, freestanding system furniture, computer software storage arrangements, microfiche storage systems, desk pedestals, and similar display, merchandising or drawer assemblies.

With respect to the above mentioned liner useable in a drawer 12, the same could be a box made of cardboard, thermoplastic, wood or metal (solid or wirebasket type) which is easily removable from its drawer. Further, a cover could be furnished or fabricated to cover the liner for future storage applications or for ease in moving the liner without spilling its contents.

The bearing track assemblies 32, 34 could be either a single action, double action, or multiple action design with the ball bearings 38, 56 being constructed of metal, nylon or some other known material composition suitable for the intended purpose. Similarly, the rollers 26 could be formed of nylon, rubber, metal, or some similar material. A rubber or nylon assembly is more desirable due to the reduction of noise as the assembly is used, as well as the achieving of a cushioning effect.

With respect to the above description then, it is to be realized that the optimum dimensional relationships for the parts of the invention to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative of the principles of the invention. Further, since numerous modifications and changes will readily occur to those skilled in art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tiltable drawer assembly comprising:

a. drawer means;

b. drawer support means fixedly securable within a cabinet means;

c. track means forming a part of said drawer support means, said drawer means being slidably attached to said track means;

d. hinge assembly means permitting a desired tilting of said drawer means during an extension thereof from said cabinet means, said hinge assembly means being fixedly secured between said track means and a bottom portion of said drawer means, whereby said drawer means is suspended from said hinge assembly means during said tilting of said drawer;

e. cam means fixedly secured to a forward bottom portion of said drawer means, said cam means being engageable with a follower means forming a part of said track means, said cam means controlling an initial tilting of said drarwer means during an extension thereof from said cabinet means;

f. first stop means for limiting said extension of said drawer means from said cabinet means, said stop means being operative only when the drawer is tilted, said stop means including a stop engaging member being engageable with a stop member fixedly secured to said drawer support means;

g. second stop means serving to limit further drawer extension from said cabinet means after a movement of said drawer means past said first stop means, said second stop means including an engagement of said track means with said follower means, said drawer means being movable down into a first tilt position when said drawer means is in engagement with said first stop means, said drawer means being movable down into a greater tilt position when said drawer means in in engagement with said second stop means.

2. The tiltable drawer assembly of claim 1, wherein said drawer means may be moved upwardly to permit said stop engaging member to move up and over said stop member, thereby to permit said drawer means to move forwardly into engagement with said second stop means.

3. The tiltable drawer assembly of claim 2, wherein said track means includes a first channel member mounted to said drawer support means, a second channel member mounted to said bottom portion of said drawer means, and a ball bearing retaining member slidably movable and captured between said first and second channel members.

4. The tiltable drawer assembly of claim 3, and further including a rearwardly positioned support member attached to said bottom portion of said drawer means, said support member serving to maintain said drawer means in a horizontal level position when said drawer means is positioned interiorly of said cabinet means.

5. The tiltable drawer assembly of claim 18, wherein said cam means includes a first horizontal level surface engageable with said follower means, thereby to permit an initial extension of said drawer means without any tilting thereof;

6. The tiltable drawer assembly of claim 5, wherein said cam means further includes an upwardly extending kick planar surface integrally attached to said first horizontal level surface, whereby an initial tilting of said drawer is achieved when said follower means engages said upwardly extending planar surface.

7. The tiltable drawer assembly of claim 6, wherein said follower means engages said bottom portion of said drawer means subsequent to an engagement of said upwardly extending planar surface and during a further extension of said drawer means for said cabinet means, said bottom portion serving as a further cam means for controlling said tilting of said drawer means during an extension thereof from said cabinet means.

* * * * *